US008839472B2

(12) United States Patent
Ferrell

(10) Patent No.: US 8,839,472 B2
(45) Date of Patent: Sep. 23, 2014

(54) COMPACT ARM/HAND RESTING PILLOW

(75) Inventor: George Ferrell, Washington, DC (US)

(73) Assignee: Resting Concepts LLC, Washington, DC (US)

( * ) Notice: Subject to any disclaimer, the term of this patent is extended or adjusted under 35 U.S.C. 154(b) by 244 days.

(21) Appl. No.: 13/206,648

(22) Filed: Aug. 10, 2011

(65) Prior Publication Data

US 2013/0000042 A1 Jan. 3, 2013

Related U.S. Application Data

(60) Provisional application No. 61/503,117, filed on Jun. 30, 2011.

(51) Int. Cl.
*A47G 9/10* (2006.01)

(52) U.S. Cl.
USPC ..... 5/636; 5/630; 5/646; 2/16

(58) Field of Classification Search
USPC ..... 5/636, 630, 655, 639; 2/16, 18
See application file for complete search history.

(56) References Cited

U.S. PATENT DOCUMENTS

| | | | | | |
|---|---|---|---|---|---|
| 4,393,520 | A | | 7/1983 | Koch | |
| 4,424,595 | A | * | 1/1984 | Albert | 2/18 |
| 5,159,727 | A | * | 11/1992 | McCracken | 5/655 |
| 5,239,717 | A | * | 8/1993 | Sue | 5/655 |
| 5,361,415 | A | * | 11/1994 | Deering et al. | 2/158 |
| 5,440,769 | A | * | 8/1995 | Thomas | 5/655 |
| 5,652,955 | A | * | 8/1997 | Skewis | 2/20 |
| 5,665,113 | A | | 9/1997 | Decker et al. | |
| 5,715,535 | A | * | 2/1998 | Hamilton et al. | 2/59 |
| 6,014,770 | A | * | 1/2000 | Spector | 2/18 |
| 6,041,458 | A | * | 3/2000 | Vickers et al. | 5/636 |
| 6,119,267 | A | * | 9/2000 | Pozzi | 2/20 |
| 6,141,801 | A | * | 11/2000 | Helenick | 2/159 |
| 6,381,786 | B1 | | 5/2002 | Cadden | |
| 6,691,353 | B2 | | 2/2004 | Fuhriman | |
| 6,760,924 | B2 | * | 7/2004 | Hatch et al. | 2/161.5 |
| 6,918,148 | B2 | | 7/2005 | Auxila | |
| 7,025,709 | B2 | * | 4/2006 | Riggall | 482/49 |
| 7,131,156 | B1 | * | 11/2006 | Walker-Craft | 5/655 |
| 7,383,590 | B1 | * | 6/2008 | Duncan | 2/158 |
| 7,562,398 | B2 | * | 7/2009 | Beland et al. | 2/161.1 |
| 7,578,004 | B2 | * | 8/2009 | Loyens et al. | 2/16 |
| 7,682,324 | B2 | | 3/2010 | Pillari | |
| 7,814,572 | B2 | * | 10/2010 | Van Trojen | 2/162 |
| 2004/0226075 | A1 | * | 11/2004 | Marchal | 2/160 |
| 2005/0245360 | A1 | * | 11/2005 | Saul | 482/56 |
| 2006/0179574 | A1 | * | 8/2006 | Margalit | 5/655 |
| 2007/0204373 | A1 | * | 9/2007 | Loyens et al. | 2/16 |
| 2008/0104737 | A1 | * | 5/2008 | Shepherd | 2/20 |
| 2009/0100561 | A1 | * | 4/2009 | Holmes | 2/16 |
| 2010/0024088 | A1 | * | 2/2010 | Griefer | 2/16 |
| 2011/0035861 | A1 | * | 2/2011 | McDonald | 2/161.1 |
| 2011/0173733 | A1 | * | 7/2011 | Krzeminski | 2/16 |

* cited by examiner

*Primary Examiner* — Brittany Wilson
(74) *Attorney, Agent, or Firm* — Dort Patent, P.C.

(57) ABSTRACT

A combination sleeve/glove pillow allows extra comfort for arm sleepers and in situations like workbreaks or unusual sleeping quarters. A padded cylindrical pillow material between 1 and 3 cm thick and between 20 to 30 cm long is covered with cloth, allowing an arm to slide through. The cylindrical section is then attach to an upper and lower hand portion, each of which include pillow material covered with cloth, and attached to each other. The pillow provides comfort under multiple scenarios while allow the user free hand movement.

9 Claims, 9 Drawing Sheets

COMPACT ARM/HAND RESTING PILLOW

REFERENCE TO PRIORITY DOCUMENTS

This application claims priority under 35 USC §119(e) to U.S. Provisional Patent Application No. 61/503,117, filed Jun. 30, 2011, entitled Compact Arm/Hand Resting Pillow, which is incorporated by reference in its entirety for all purposes.

SUMMARY

The present invention is a "sleeve" or "glove" pillow (a sleeve in a preferred embodiment) that allows a users hand and/or arm to slide through. In general, the invention or the Sleep Buddy™ or Rest Buddy™ is for those users who rest or sleep with their arm or hand under their head. The applications of the invention may be a resting pillow for travel or workbreak, or an alternate embodiment in which it is used for nighttime or special position resting like surgery. The pillow includes an generally cylindrical arm portion and two connected hand portions, and is made of safe and fire-resistant materials and is compact, flexible and portable so that it can be easily carried or placed in a bag.

BRIEF DESCRIPTION OF THE DRAWINGS

FIG. 3 is an illustration and detail of the first embodiment looking into the arm slide through;

DETAILED DESCRIPTION OF THE DRAWINGS

Figure 1A:
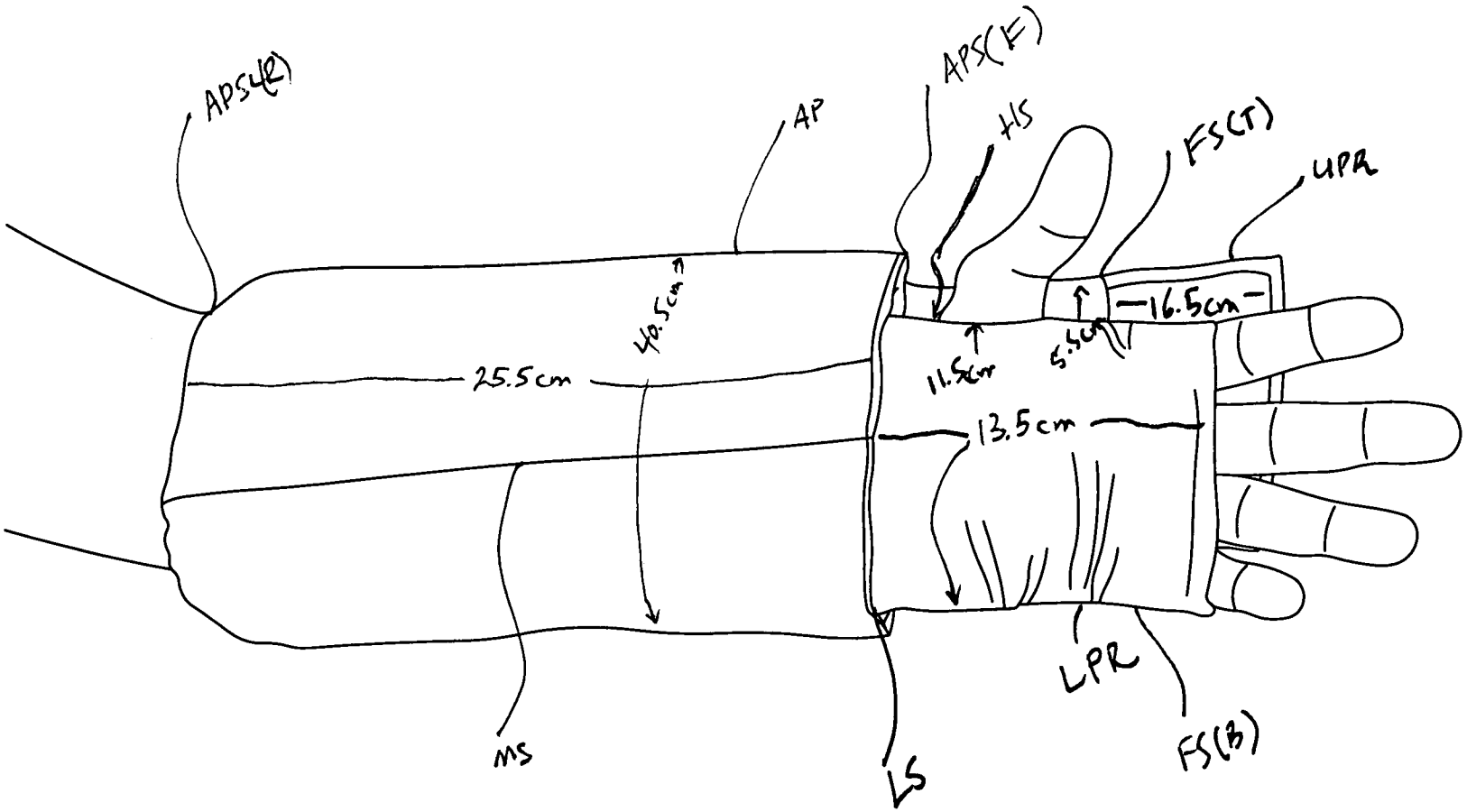
FIG. 1A illustrates a first embodiment of the hand/finger pillow (in use) from a side perspective.

FIGS. 1A-D illustrates a main embodiment of the invention, the Sleep Buddy™ as shown in a first configuration. The first configuration of the main embodiment is in the form of the sleeve/arm pillow with hand portions.

FIGS. 1A-D illustrate the details of a particular embodiment of the finger/hand pillow. Any dimensions shown are for illustration purposes and are not meant to limit the invention to one particular set of parameters, but rather to provide an example of how the pillow may be constructed. The hand is inserted into the arm pillow space APS, which is formed by the body of the main arm pillow, AP and slid through into the hand space HS, which is formed by the upper hand part UPR and the lower hand part LPR which are connected by two fastening straps FS(T) and FS(R) on opposite sides about 7.5 cm up each respective part, and stitched towards to tip of the respective hand parts. In general, the upper hand part UPR is slightly longer than the lower hand part LPR by about 3 cm. This asymmetry accommodates finger movement and comfort, but is not necessary.

The arm pillow section AP is generally made of a piece of material that is stitched along a main seam MS (inside main seam not shown) to cover a mostly hollow cylinder of pillow foam (not shown) that is generally between 1 and 3 cm thick. The piece of material stitched around the cylindrical pillow foam or the foam and the arm pillow section material are stitched or formed into a cylinder whichever is more efficient for the manufacturer. In the embodiment shown, the pillow material inside the arm portion is a generally uniform thickness, between 1 and 5 cm, optimally between 2 and 3 cm. However, in alternate configurations (see below) the thickness of the pillow material may be tapered, or increased in the area in which a user generally rests their heads, providing additional padding without adding much bulk.

In general, the arm pillow section AP is covered by a material that is washable, (usually) stretchable, and easy to maintain and that will also allow a print pattern in particular configurations. The arm slide though APC, allows the pillow to be fixed on the arm, and the material of the arm pillow AP, usually a poly foam material that is easily stretched so that arm slide-through doesn't constrict the arm, but also fits such that it will not easily slide off. (Usually between 7-13 cm in diameter for an adult arm, and in the illustrated embodiment approximately 9 cm in diameter).

The arm pillow AP is connected, usually through stitching ST or simply a single piece of foam in a different cut to the hand portion HP. In the embodiment illustrated, the arm pillow AP is a separate section of poly foam or pillow, from the hand portion UPR/LPR. The hand portion includes a finger strap FS(T/B) on either side that connects a top portion UPR and a bottom portion LPR (on both the inside and outside) and allows the hand to "slide" through, such that normally, a user's thumb is outside the strap and there is a glove fit. While the thicknesses of the top portion and bottom portion UPR, LPR are shown as between 1 and 3 cm thick, the top portion may be changed depending on the needs of the user. For example, users are expected to rest with their heads on the top of the hand, so a thicker portion on the top portion TP may be preferred in particular embodiments.

TABLE 1.1 sample dimensions of external components

| Component | Place | Dimension X | Dimension Y |
|---|---|---|---|
| Arm Portion (AP) | Main Sleeve | 38.5 cm (30-50 cm) | 54.5 cm (50-60) |
| Lower portion (LPR) | Bottom of palm | 23 cm (+/−20%) | 31 cm (+/−20%) |
| Upper portion (UPR) | Top of hand | 23 cm (+/−20%) | 34 cm (+/−20%) |
| Elastic Straps (FS) | Connecting two portions | 3-6 cm | 2-4 cm. |

TABLE 1.2 sample dimensions of internal components

| Component | Place | Dimension X | Dimension Y |
|---|---|---|---|
| Cylindrical Pillow for arm portion | Arm Portion | 40 cm diameter (9 cm hollow) when rolled. | 25.5 cm |
| First Rectangular portion (Lower) | Lower portion | 13 cm | 11 cm |
| Second Rectangular Portion (Upper) | Upper portion | 16 cm | 11 cm |

FIG. 1A illustrates the component parts and some suggested dimensions. Although, the dimensions are not to be limiting but rather are for guidance as to the manufacture. The arm portion AP is generally about 25.5 cm long, but should be between 24 and 30 cm. If the arm portion AP is too long, the pillow will not allow for the freedom of movement for the elbow. FIG. 1A also illustrates the components seams (for this particular embodiment). Where the arm slide through AST meets the hand space HS, the arm portion AP is attached to the upper and lower hand portions UPR/LPR by stitching (although, in other embodiments these stitches may not be needed). These connecting seams (shown as lower seam LS and upper seam US) occur in the section of arm portion and the respective hand portion overlap. As stated above, the cloth covering each section is cut slightly longer that the amount need to cover the respective pillow portions so that the stitching may be secure and durable.

Figure 1B:
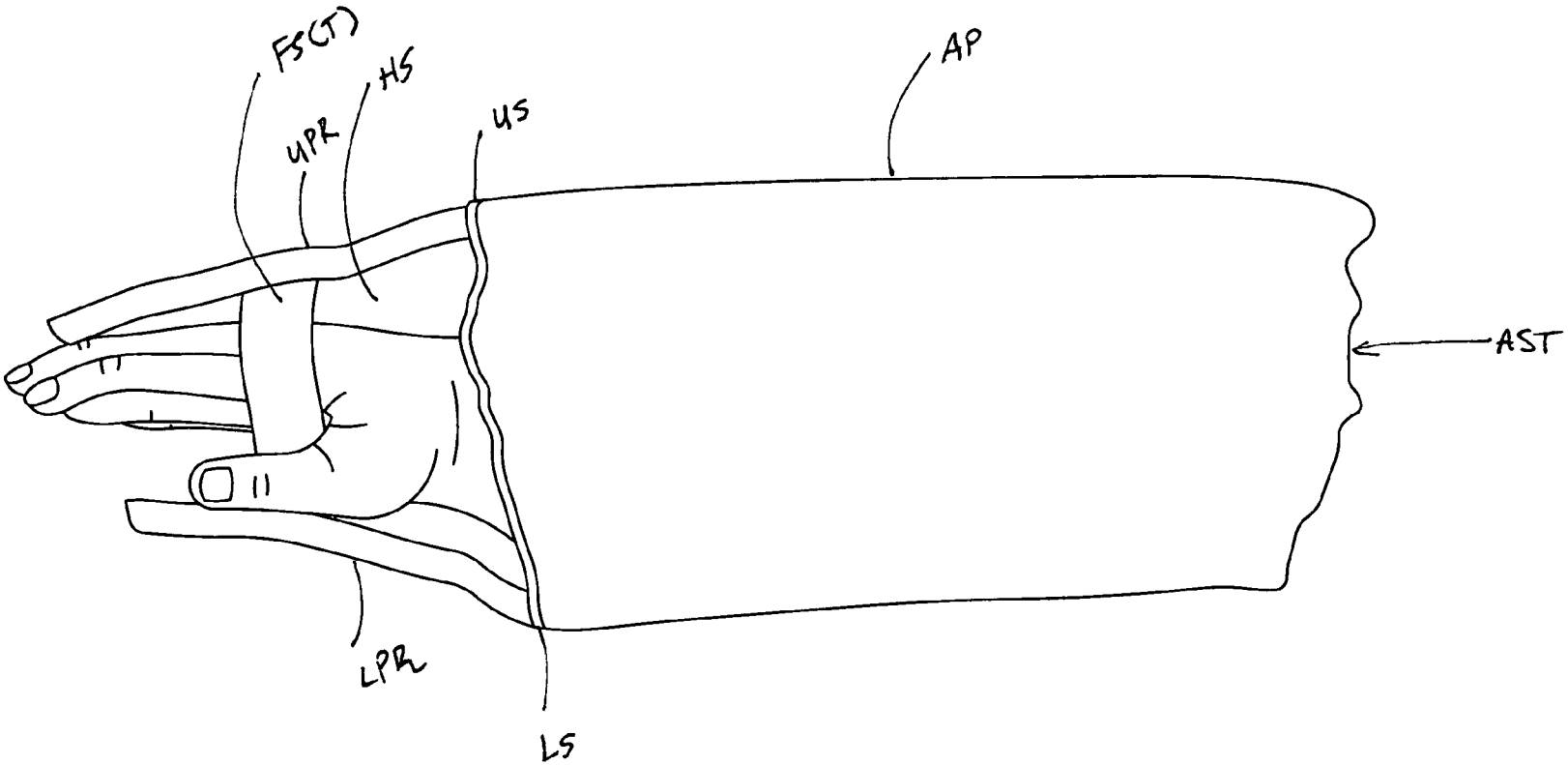
FIG. 1B illustrates a first embodiment of the hand/finger pillow (in use) from a rotated view (90 degrees from FIG. 1A)

FIG. 1B illustrates the main embodiment of the pillow executing a 90-degree arm rotation from the illustration in FIG. 1A. Clearly illustrated is the thumb extending out around the upper connecting strap FS(T). Also shown in this illustration is the fact that the user has chosen to place the upper hand portion UPR along the top of their hand. However, other users may prefer the reverse and have the long portion UPR in the palm of their hand. Thus, the pillow may provide versatile comfort. An alternate embodiment described below places special padding or material where the thumb meets the connecting strap FS(T) so that a user with especially intense hand/thumb movements will not chaffe against the connecting strap.

Figure 1C:
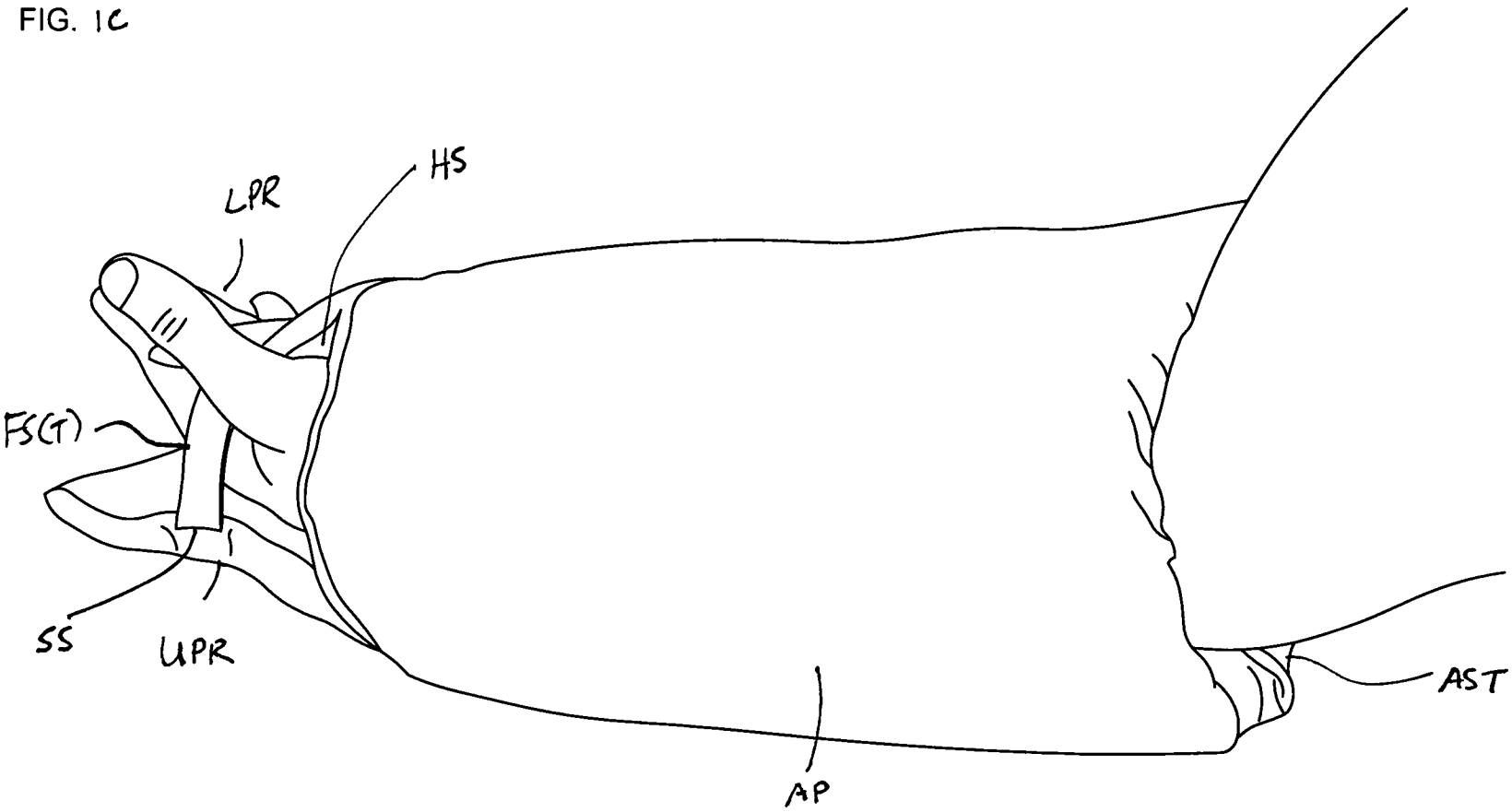
FIG. 1C illustrates a first embodiment of the hand/finger pillow (in use) from a rear side view.
Figure 1D:
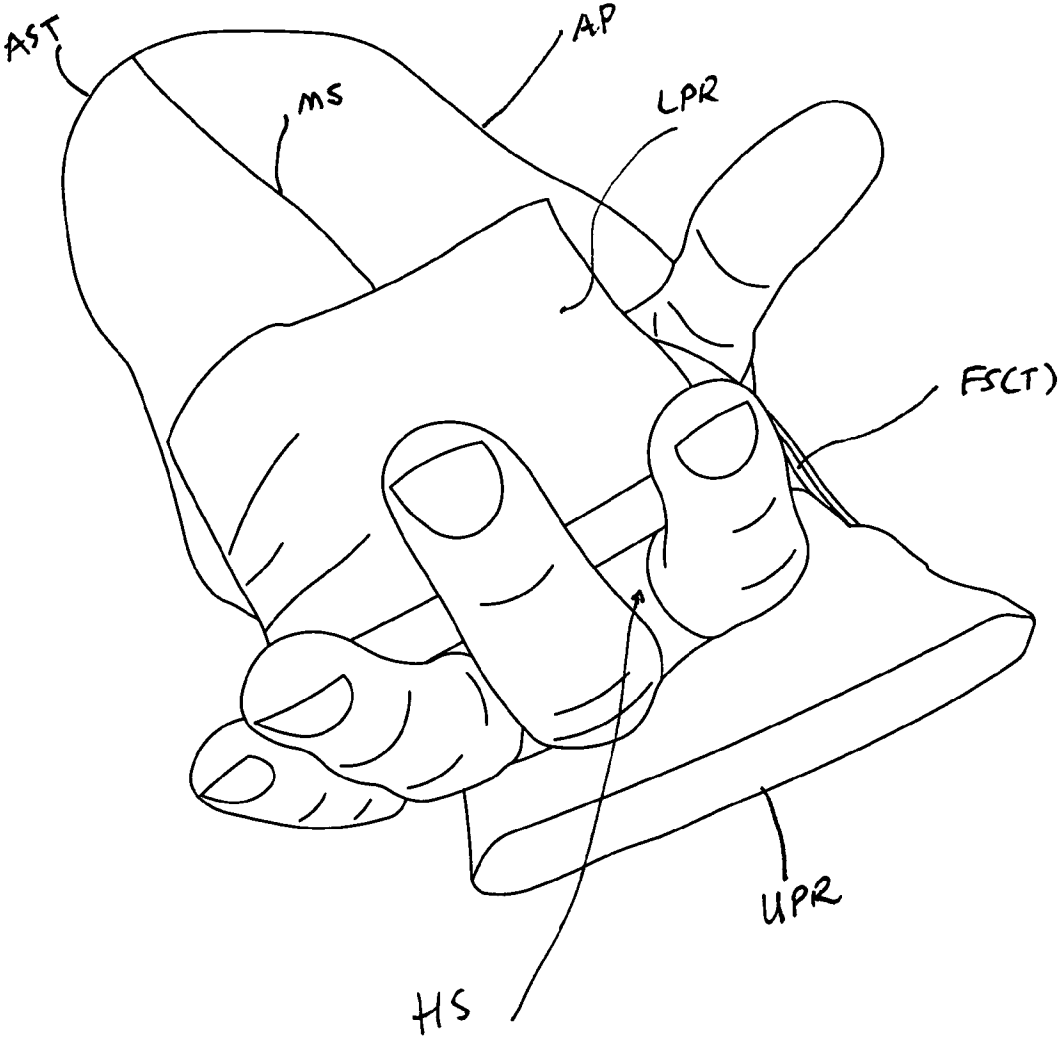
FIG. 1D illustrates a first embodiment of the hand/finger pillow (in use) from a front perspective.

FIG. 1C illustrates the main embodiment of the pillow from ¾-rear view with arm rotated upward. FIG. 1D illustrates the main embodiment of the pillow from the top of the hand view. As shown, both the upper and lower hand portions UPR/LPR have a rounded or seamless "top." Indicating that the rectangular pillow portion was "slid into" from the bottom and the covering cloth was stitched at the sides. Such a configuration is not needed and is described for illustrative purposes only. By stitching the rectangular covering cloth at the sides, a single seam closes the rectangular section around the pillow foam and attached the connecting band, saving an additional step.

Figure 2A:
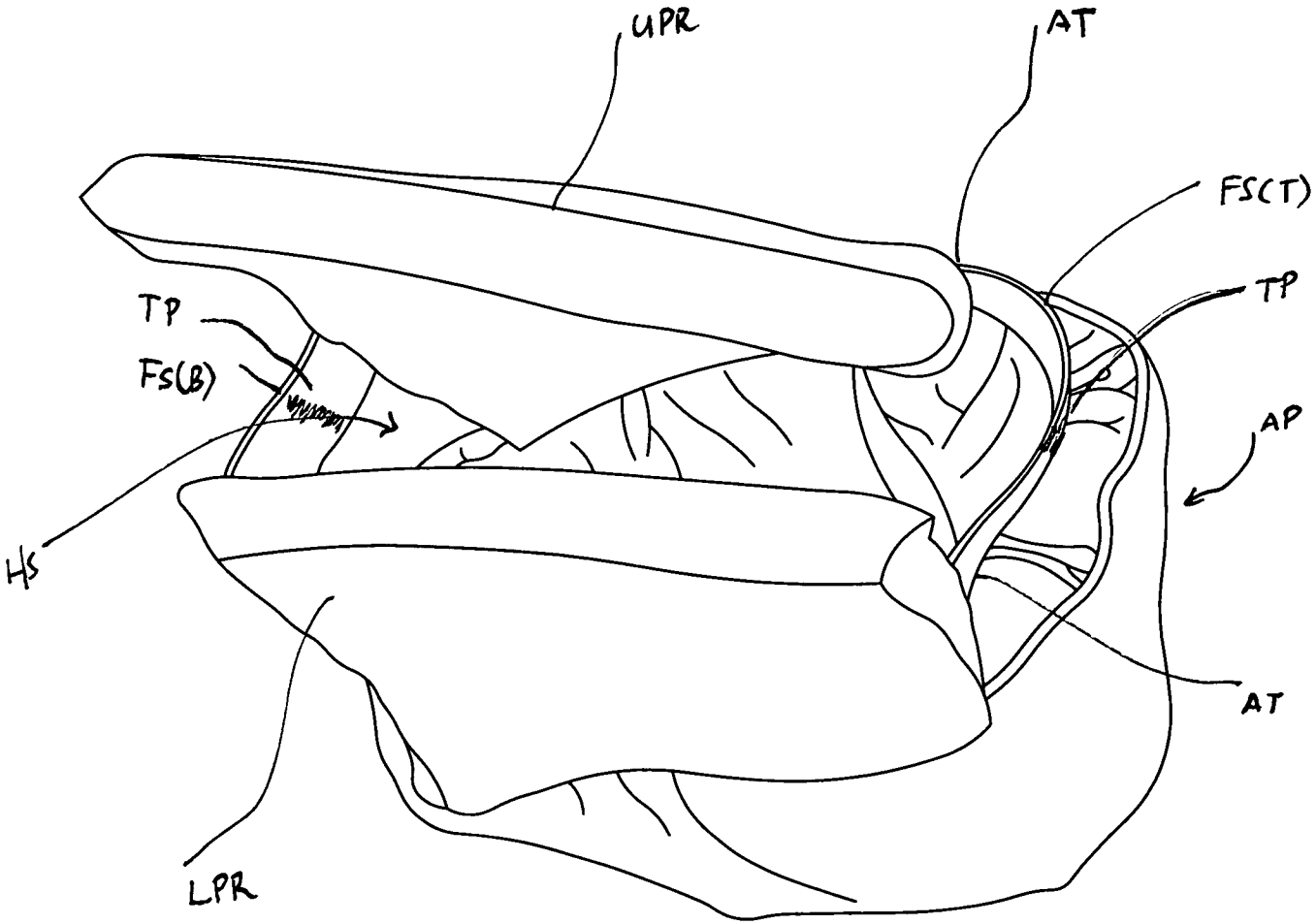
FIG. 2A is an illustration and detail of the first embodiment looking from the "front" into the hand space.

FIG. 2A illustrates a detail view of the hand space HS, from a top view. The components are generally the same as shown in FIGS. 1A-D except that there is an optional thumb protector TP location on the connection straps FS(T/B). The thumb protector TP may simply be a small portion of polyester or satin or other soft material that keeps the thumb from chafing on the connecting strap.

Figure 2B:
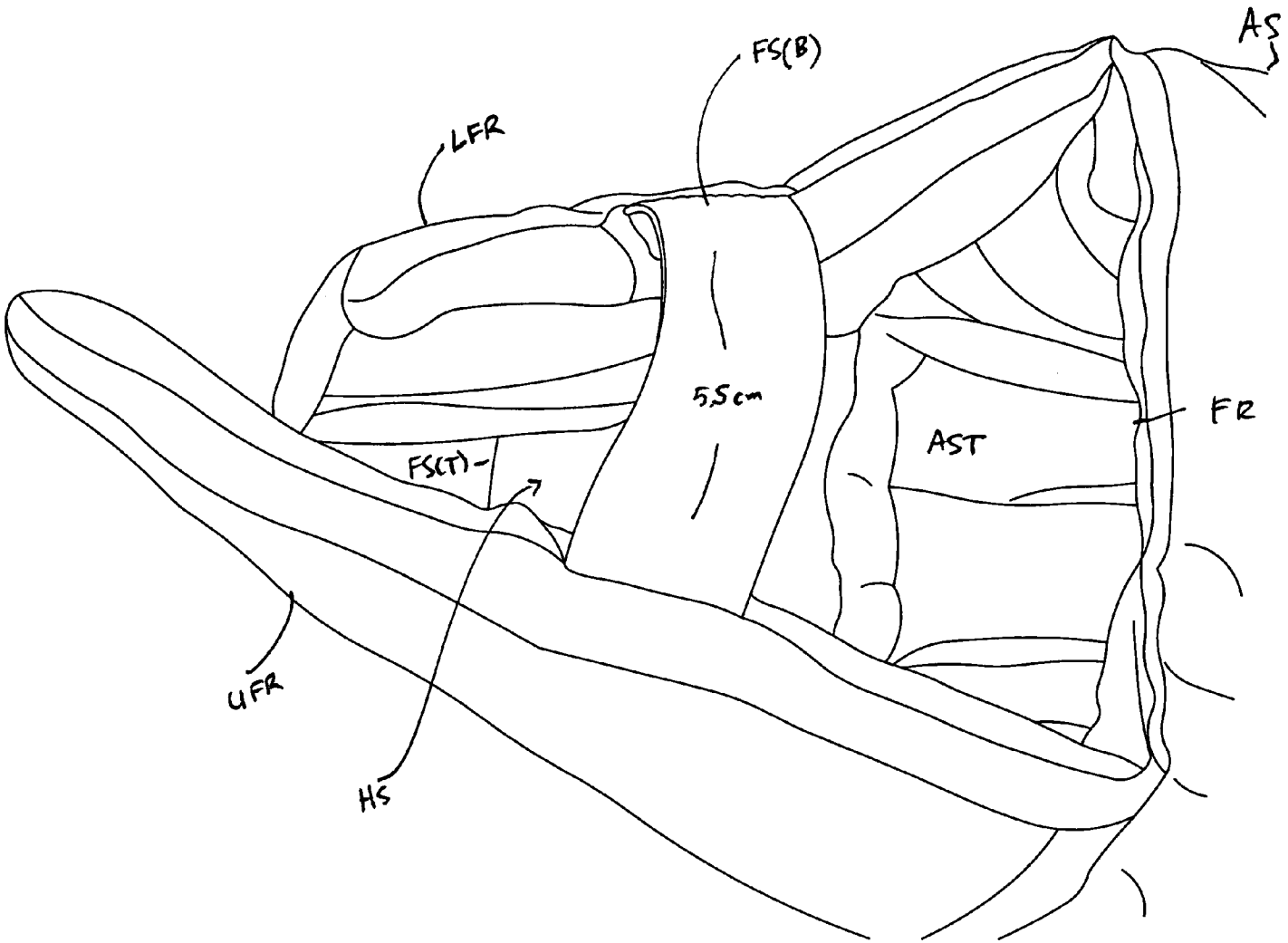
FIG. 2B is an illustration and detail of the first embodiment looking from the "side" into the hand space.

FIG. 2B illustrates a detail of the hand space HS from a side view. In general, the connecting straps FS(B/T) should be around 5 cm, and allow for freedom of movement of the hand and fingers between the lower and upper hand portions of the pillow, but also being close enough for comfort. In alternate embodiments, these straps may be adjustable or attach at variable tension with Velcro.

Figure 3:
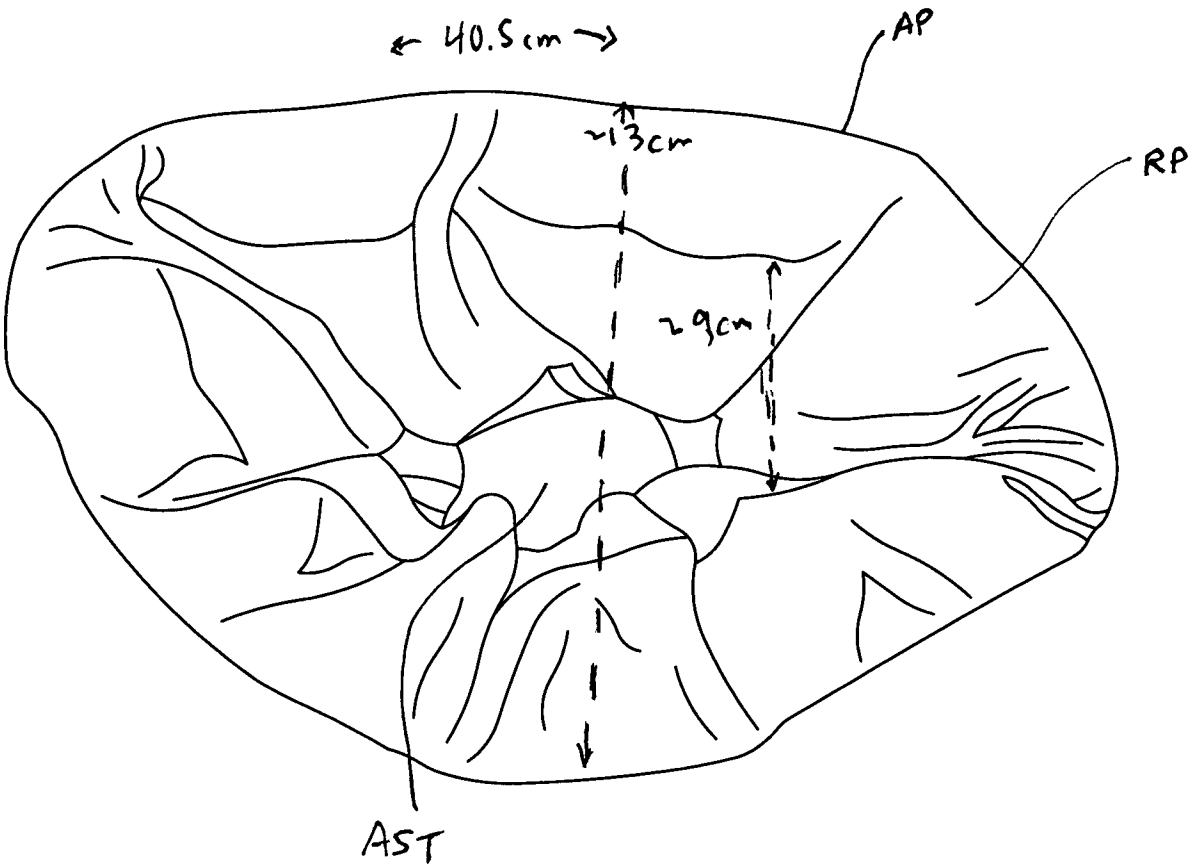

FIG. 3 illustrates the detail view of the arm slide through AST from the rear. The pillow is shown as partially collapsed to illustrate how the pillow will generally look. However, as noted below, a stiff padding may be used for the arm pillow material if desired. In the embodiment shown, the circumference of the arm pillow portion is about 40 cm. Variable circumferences may be used depending on a user's arm. However, between 35 and 45 cm is generally thought to be the right circumference for the average adult arm to provide both comfort and fit. In general, the arm slide through is shown to be about 9 cm in diameter, which should be approximately the average adult arm. Using a material that stretches to cover the arm pillow material will provide some flexibility for arm fit, but the arm portion should not too easily slide to the upper arm, even if the thumb is around the connecting strap.

Figure 4:
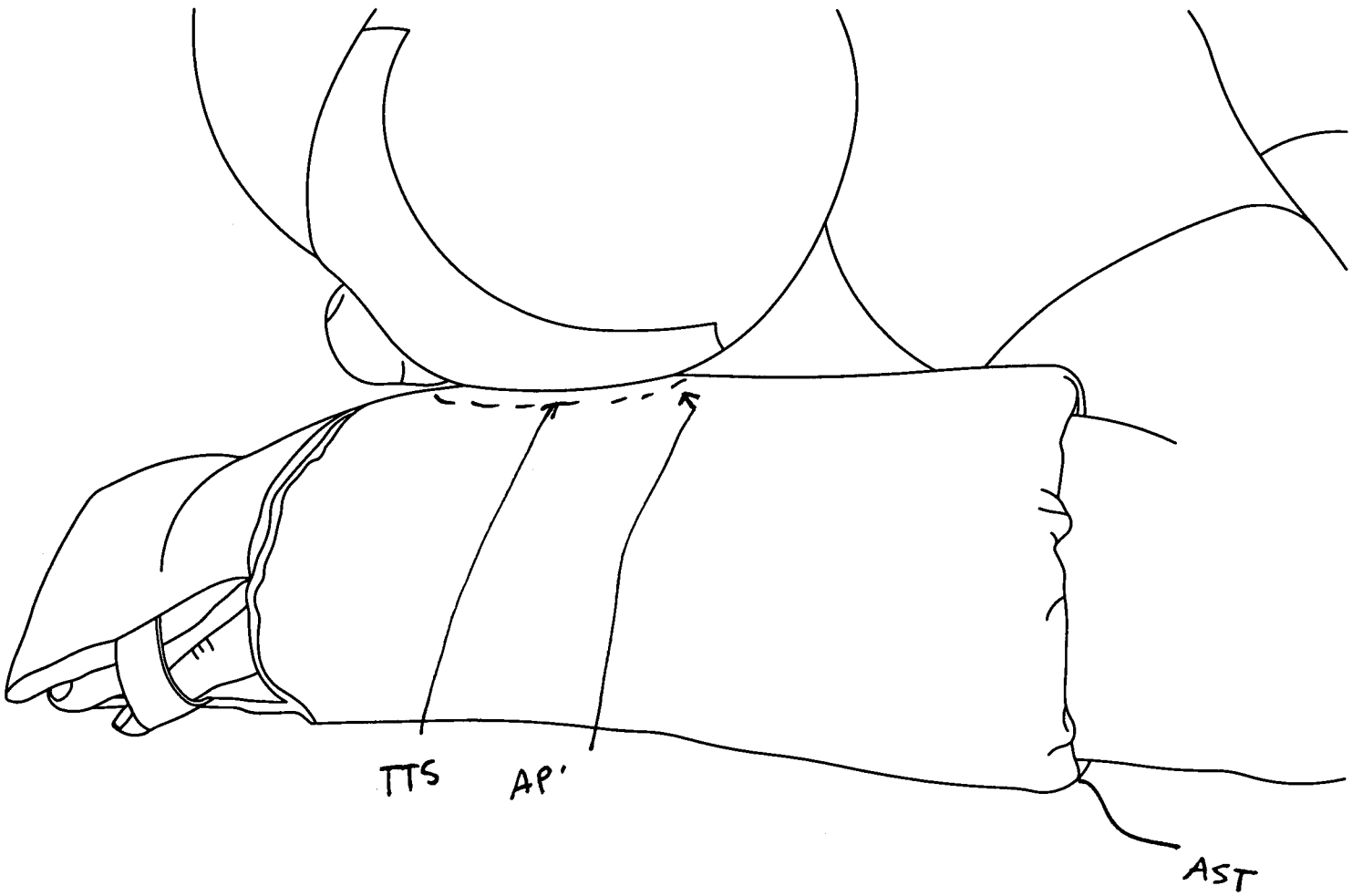
FIG. 4 is an illustration of a first sample usage and optional features of the first embodiment.

FIG. 4 illustrates an alternate configuration of the main embodiment of the arm pillow in a first use. The user is resting his head on the arm portion AP' of the alternate configuration. In order better accommodate this particular use, the pillow foam/material on the inside of the arm portion AP' is thicker in the center of the arm portion TTS where the user rests his head. This allows for extra padding between the head and arm without adding much bulk to the pillow. In addition, the padding may be tapered slightly to accommodate the forehead for an additional option.

Figure 5:
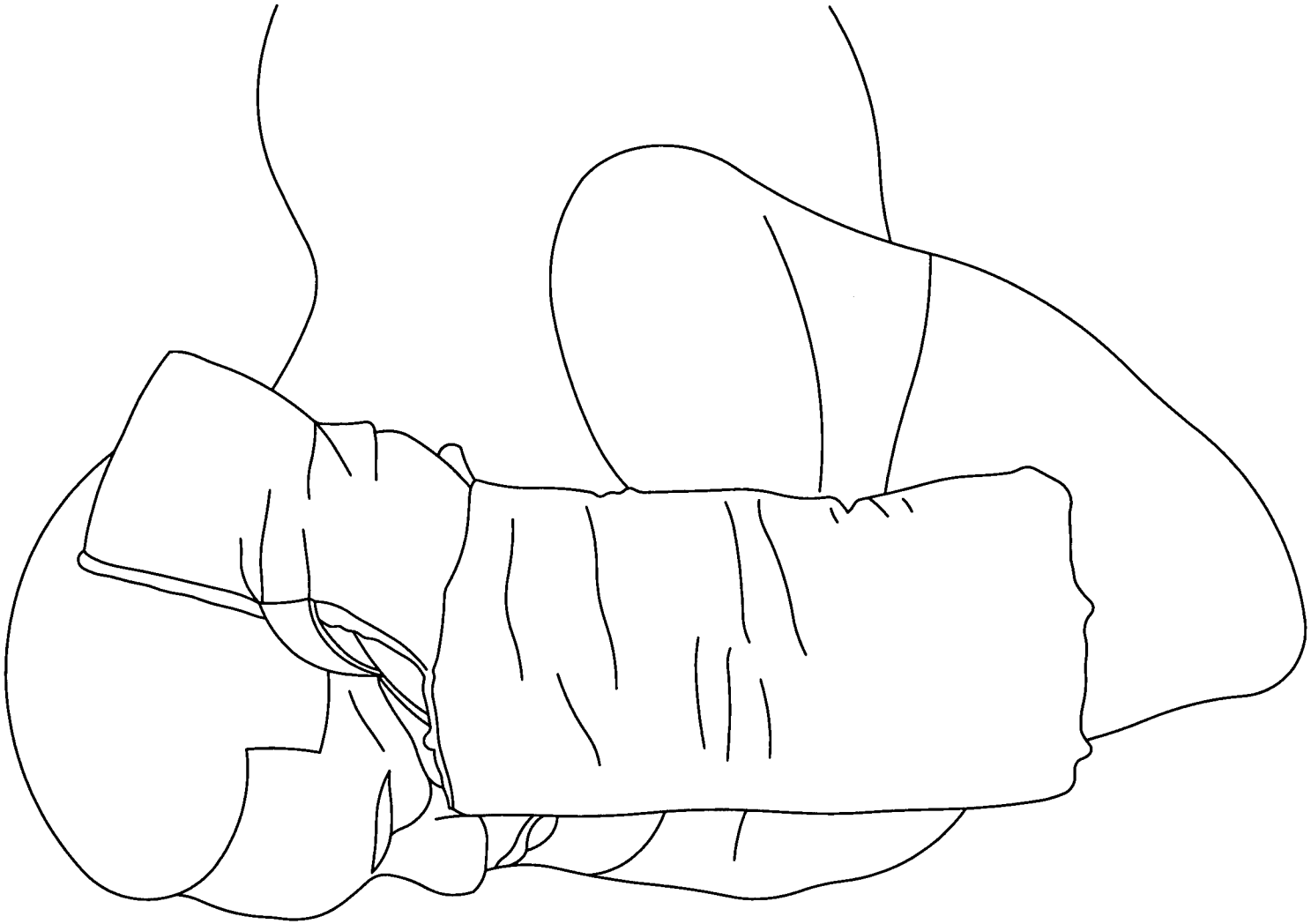
FIG. 5 is an illustration of a second sample usage and optional feature of the first embodiment.

FIG. 5 illustrates a second use of the arm pillow, where the user either has his hand pressed against his face or (as his rolls to his side), his face on the either hand pillow section. In this situation, the sleeper's arm/hand is protected from the weight of the head and vice versa.

In general, the covering portion of covering cloth may be one piece in both the arm pillow AP and the hand pillow HP, but the underlying foam cushions are separate sections, such that the pillow retains its structural integrity with rugged use. Different configurations may be implemented based on efficient manufacture of the product and other requirements for textiles and related products. In general, in the main embodiments shown, the different pieces are fastened together by stitching. And each cloth piece should allow for 0.25 to 1 cm of overlap for proper construction and strength in usage of the pillow.

However, various construction techniques may be implemented without departing from the scope of the invention. For example, in mass production a single piece of pillow foam cut into the overall shape may be covered by one or more pieces of pillow covering cloth, thus saving connecting steps. Although the shapes of the component pieces would appear irregular, the final product would function in the same way.

In general, the materials of the inventive pillow are 100% polyester fiber, for ease of use, light weight and portability. The cover may be a polyester/cotton blend (90/10 in a preferred embodiment). Other materials may be appropriate for use based on local and federal requirements. Fire resistance and other safety issues may be involved in the selection of specific materials. Users may prefer a stiffer foam if they press their heads into their arms while they sleep or rest and such materials are clearly contemplated by the scope of the invention. Hypoallergenic materials used as both pillow foam and covering will help alleviate people allergy symptoms. Washable materials are preferred and rugged construction will allow for simple placement of the pillow in the washing machine in order to clean. In certain environments, antimicrobial material may provide additional cleanliness, particularly in uses, such as a work environment (such as a tractor-trailer or work break room) that may not provide a sanitary or easily cleaned environment.

A (detachable) forearm piece of the arm pillow is contemplated as an alternate embodiment of the arm pillow and is for people that sleep with their forearm under their head or face. An elastic band may be located around the wrist for those who prefer such a configuration.

I claim:

1. A pillow that slides over a forearm, including: a generally cylindrical pillow stuffing section, mostly hollow, of a first thickness and of a first diameter, covered with a first piece of cloth, both on the inside and outside, to create an forearm portion; said forearm portion attached to a first rectangular hand portion along a first section at a first end of said forearm portion, said first rectangular hand portion including a first rectangular pillow stuffing covered with a second piece of cloth; said forearm portion attached to a second rectangular hand portion along a second section at said first end of said forearm portion, said first rectangular hand portion generally opposite to said second rectangular hand portion, said second rectangular hand portion including a second rectangular pillow stuffing covered with a third piece of cloth; at least two connecting pieces connecting said first rectangular hand portion to said second rectangular hand portion, such that a hand slides through said forearm portion and is sandwiched in between said first and second rectangular hand portions.

2. The pillow as recited in claim 1, wherein said first rectangular hand portion is longer than said second rectangular hand portion.

3. The pillow as recited in claim 2, wherein said at least two connecting pieces are made of elastic straps, between 3 and 6 cm long.

4. The pillow as recited in claim 1, wherein said forearm portion is between 22 and 30 cm long.

5. The pillow as recited in claim 4, wherein said first and second rectangular portions are between 10 and 20 cm long, and between 9 and 13 cm wide.

6. The pillow as recited in claim 1, wherein said first cylindrical pillow stuffing section is at least 1 cm thick, but less than 3 cm thick.

7. The pillow as recited in claim 1, wherein said cylindrical pillow portion has a tapered thickness, such that the diameter is wider at the end opposite said two rectangular hand portions, such that it fits the natural tapered dimensions of a forearm.

8. The pillow as recited in claim 1, wherein the cylindrical pillow portion has a deeper thickness in the center than at both ends.

9. The pillow as recited in claim 1, wherein said cloth covers of said cylindrical and first and second rectangular pillow sections are of a bacterial-resistant material.

* * * * *